United States Patent [19]

Wienhold

[11] 4,336,921

[45] Jun. 29, 1982

[54] JACK EXTENSION

[76] Inventor: Edgar K. Wienhold, 1100 Lamar Dr., Kamloops, B.C., Canada, V2C 5C4

[21] Appl. No.: 243,461

[22] Filed: Mar. 13, 1981

[30] Foreign Application Priority Data

Mar. 6, 1981 [CA] Canada ..... 372441

[51] Int. Cl.[3] ..... B66F 5/00

[52] U.S. Cl. ..... 254/8 B; 254/1; 254/10 B; 254/133 R

[58] Field of Search ..... 254/1, 8 R, 8 B, 8 C, 254/10 R, 10 B, 10 C, 124, 133, 134

[56] References Cited

U.S. PATENT DOCUMENTS

| | | | |
|---|---|---|---|
| 2,814,394 | 11/1957 | Witcher | 254/8 B |
| 3,834,669 | 9/1974 | Reid | 254/133 |
| 4,123,038 | 10/1978 | Meyers | 254/134 |
| 4,231,550 | 11/1980 | Caotoe | 254/134 |

FOREIGN PATENT DOCUMENTS

| | | | |
|---|---|---|---|
| 548979 | 11/1942 | United Kingdom | 254/133 R |

*Primary Examiner*—Hubert C. Watson

*Attorney, Agent, or Firm*—Stanley E. Johnson; Richard J. Hicks

[57] ABSTRACT

An extension for a common trolley type service jack that includes an elongate rigid frame with a tunnel extending inwardly from one end thereof to receive the jacking end portion of the trolley type service jack. The rigid frame bears downwardly on the frame of the service jack adjacent the entry to the tunnel and inwardly thereof are supports for the wheels of the trolley jack. A lift platform is attached to the rigid frame by a lever pivotally attached at one end to the lift platform and at the other end to the rigid frame and overly the tunnel. The lever extends beyond the tunnel and on the free outer end is mounted the lift platform, the lever being pivotally movable by the lift portion of the jack to raise the lift platform of the jack extension.

1 Claim, 3 Drawing Figures

JACK EXTENSION

This invention relates to an extension for a common trolley type service jack and such extension with the jack in combination therewith.

Service jacks, also known as trolley jacks and floor jacks, are normally lever operated hydraulic jacks mounted on wheels for rolling on garage floors and used to lift the side or end of vehicles or machines.

Service jacks are robust and have a relatively short lift. Service jacks are low in height so they can be readily pushed under a vehicle from the side or front. They have a lever arm which is pivotally mounted and raised and lowered by way of a hydraulic cylinder means. On the free end of the lever arm is a relatively small pad for abutting the underside of the frame of the vehicle or axle as the case may be depending upon which portion of the vehicle is to be lifted. Because of the short lift or travel of the lever arm, service jacks are limited in their use. Vehicles vary considerably in their clearance from the ground; for example, a truck frame is relatively high compared to the frame of a passenger car. A service jack that might be suitable for lifting the side or end of a passenger car may not have sufficient travel to lift a truck for servicing or, for example removing a wheel for changing a tire. Service jacks are also relatively narrow and thus provide insufficient stability to support unstable parts; for example, removal of a transmission from a car or truck. The amount of travel also may be beyond the capacity of a normal service jack for removing transmissions and thus in most instances in the past a separate transmission jack has been used for such tasks.

An object of the present invention is to provide a removable extension converting a regular service jack to a transmission jack providing a longer lift suitable for such purpose and increasing the stability of the jack.

Accordingly, in accordance with one aspect of the present invention there is provided a jack extension comprising: (a) an elongate rigid frame having a tunnel extending inwardly from one end thereof in a direction toward the other to receive the jacking end portion of a trolley type service jack, downwardly directed upper abutment means on said frame adjacent the entry to the tunnel for engaging a rigid frame portion of the trolley track and bear downwardly thereon, upwardly directed lower abutment means adjacent the inner end of the tunnel for providing a support for the front wheels of the service jack; (b) a lift platform; and (c) lever means pivotally attached to the lift platform and rigid frame thereby mounting the lift platform on the frame for movement relative thereto, said lever means overlying said tunnel and extending therebeyond with the lift platform located at the outer free end of the lever means, at least one lever of said lever means being pivotally movable by the lift part of the jack thereby to raise said lift platform of the jack extension.

In accordance with a further aspect of the present invention there is provided a removable jack extension as defined in the foregoing in combination with a service jack.

The invention is illustrated by way of example in the accompanying drawings wherein.

Figure 1:
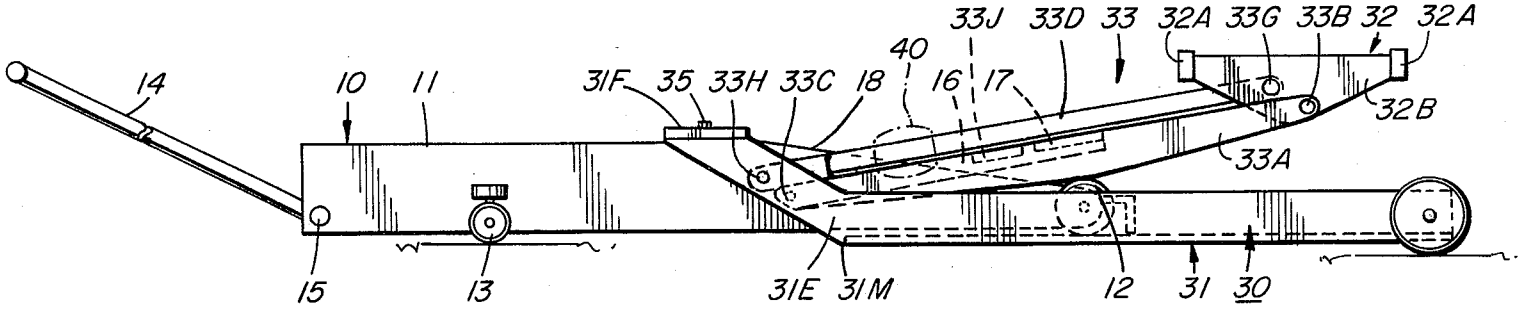
FIG. 1 is an elevational view of a common service jack provided with an extension in accordance with the present invention.

Referring to the drawings illustrated therein is a common service jack 10 having an extension 30 provided in accordance with the present invention detachably mounted thereon. The service jack, also known as a floor jack or trolley jack, conventionally have a longitudinally extending frame 11 with a pair of wheels 12 at one end thereof and a pair of castor wheels 13 adjacent the other end. At the latter end of the frame there is a handle 14 pivotally mounted as at 15 for actuating a hydraulical cylinder. A lever arm 16 is pivotally attached (16A) at one end thereof to the frame 11 and on the other opposite free end is a foot pad or lifting plate 17. Back and forth movement of the handle 14 raises the lifting pad 17 by connecting linkages and hydraulic cylinder in a conventional manner. It should at this point be noted the conventional frame 11 tapers downwardly as indicated by broken line 18 from a position approximately mid-length of the frame where the lever arm 16 is pivotally attached thereto toward the end on which wheels 12 are mounted. As the service jack 10 is a conventional jack, further description of the same is believed unnecessary.

The jack extension 30, provided in accordance with the present invention, consists of a rigid base 31 having a lift platform 32 mounted thereon by way of a lever mechanism 33.

The rigid base 31 consists of a pair of laterally spaced apart angle members 31A and 31B interconnected at one end thereof by an axle 31C on which are mounted a pair of wheels 31D. The angle members extend longitudinally and towards one end the side flanges turn upwardly as at 31E and are interconnected by a cross bar 31F. The wheels 12 of the conventional jack rest on the lower flanges of angle members 31A and 31B and during lifting the reactional forces of the rigid frame 31 are transmitted to the jack frame 11 by the cross bar 31F. The cross bar 31F can be fastened to the service jack frame 11 by a threaded stud 35 if so desired. Alternatively, the threaded stud 35 may be replaced by bolt and lock nut assemblies whereby the cross bar 31F can be selectively vertically adjusted in spaced relation relative to the jack frame 11. Alternative to having the wheels 12 of the jack rest on angle members 31A and 31B or in addition thereto the front end of the jack frame can be provided with a crossbar 31G that bears against the members 31A and 31B.

The lift platform 32 consists of a pair of spaced apart cross bars 32A interconnected by a pair of spaced apart end plates 32B.

The lever mechanism 33 consists of a first pair of lever arms 33A pivotally connected at one end as at 33B to respective ones of the platform plates 32B and at the opposite end by way of pivot pins 33C to the frame upwardly directed flange portions 31E. The pivot axis of pins 33C coincide with the pivot axis for the lever 16. The lever mechanism further includes a stabilizing bar 33D having respective cross bars 33E and 33F at opposite ends thereof. The cross bar 33E is pivotally attached as at 33G to the lift platform 32 and the cross bar 33F is pivotally attached to the frame upwardly directed portions 31E as at 33H. The pair of lever arms 33A are interconnected intermediate the ends thereof by a cross bar 33J. The cross bar 33J is a rigid member and securely attached to the respective lever arms 33A.

The jack extension is used in a manner as shown in FIG. 1 wherein the wheels 12 of the conventional floor jack are in engagement with the lower flanges of the angle members 31A and 31B and the cross bar 31F is in engagement with the frame 11 of the jack. During operation of the conventional jack the cross bar 33J engages the lever arm 16 (or pad 17 mounted thereon) of the jack 10 and upward movement of the lever arm 16 causes the lift platform 32 of the jack extension to raise. From FIG. 2 it will be readily observed the spacing between the pair of wheels 31D is substantially greater than the spacing between the wheels 12 and thus there is increased stability required when handling or supporting unstable parts such as the transmission from a vehicle. The length of the lever arm system 33 is substantially greater than that of the lever arm 16 of the jack and thus the overall travel of the platform 32 is substantially greater than that of the lift pad 17 on the conventional jack. The lever arms 33A and 33D effectively constitute a parallelogram stabilizing the lift platform 32 so that the platform remains always in a horizontal or level position.

Figure 2:
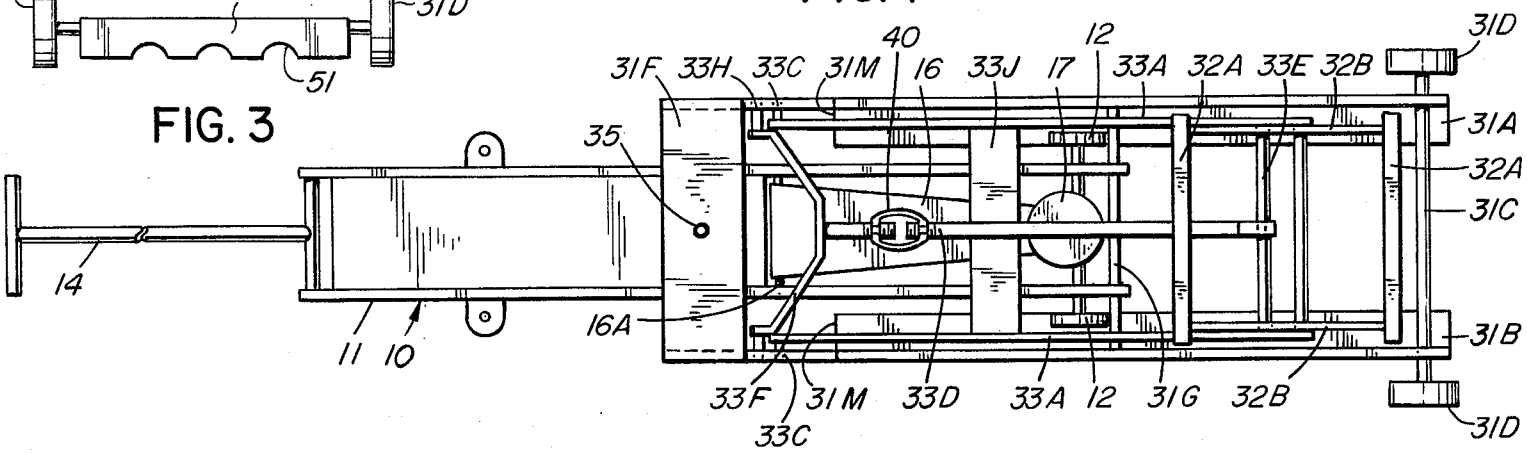
FIG. 2 is a top plan view of FIG. 1.

It will be seen from FIG. 2 the lower flange of members 31A and 31B terminate, as indicated at 31M, prior to where the flanges 31E turn upwardly. The service jack can thus be readily rolled into and out of the jack extension.

From the foregoing, it will be seen the rigid frame of the jack extension effectively has a tunnel therein for receiving the lift end portion of the trolley jack. The tunnel has an entry commencing at the cross bar 31F, which bar bears downwardly on the rigid frame of the trolley jack and extends inwardly to the point where the wheels 12 of the trolley jack bear downwardly on the flanges of the spaced apart members 31A and 31B.

In the foregoing, the lift platform 32 is described as being held in horizontal position by the parallelogram arrangement. Should, however, one wish to tilt platform 32D lever or rod 33D can easily be modified permitting adjustably varying the length thereof. This can be accomplished by having a turn buckle 40 in the rod 33D. Alternatively, rod 33D could pass through an aperture in member 33F and retained in various positions by any suitable locking means.

Figure 3:
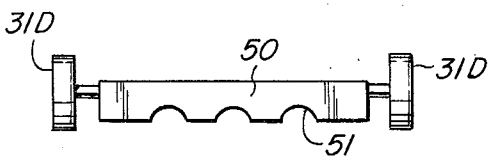
FIG. 3 is effectively a right-hand partial end view of FIGS. 1 and 2 but illustrating a minor modification thereto.

As a further modification rigid members 31A and 31B may be interconnected by a bar 50 as shown in FIG. 3 having notches 51 in the lower edge thereof. The notches spaced apart from one another provide means whereby a rod or crowbar can be inserted therein for moving the jack and extension laterally.

I claim:

1. A portable lift jack comprising a wheeled trolley jack and a wheeled attachment therefor extending the jacking range thereof said attachment comprising:

(a) an elongate low profile rigid frame having a tunnel extending inwardly from one end thereof in a direction toward the other and open downwardly receiving the jacking end portion of the trolley type service jack when rolled thereinto, downwardly directed upper abutment means on said frame, adjacent the entry to the tunnel, engaging a rigid frame portion of the trolley track and bearing downwardly thereon at a position spaced rearwardly from the forward end of the jack, upwardly directed lower abutment means adjacent the inner end of the tunnel providing a support for the forward end portion of the trolley jack;

(b) a lift platform having an upper load supporting surface disposed in a substantially horizontal plane at a position forwardly beyond the forward end of the trolley jack; and (c) lever means pivotally attached to the lift platform and rigid frame, in a parallelogram arrangement, mounting the lift platform on the frame for movement relative thereto such that said load supporting surface automatically remains horizontal during raising and lowering of the same, said lever means overlying said tunnel and extending therebeyond with the lift platform located at the outer free end of the lever means, at least one lever of said lever means being engagable with and pivotally movable by the lift part of the trolley jack.

* * * * *